US006257154B1

(12) United States Patent
Kasper

(10) Patent No.: US 6,257,154 B1
(45) Date of Patent: Jul. 10, 2001

(54) CABINET HAVING A LOCK ASSEMBLY

(75) Inventor: Kazmier J. Kasper, Hopkinton, MA (US)

(73) Assignee: Algonquin Industries, Inc., Bellingham, MA (US)

( * ) Notice: Subject to any disclaimer, the term of this patent is extended or adjusted under 35 U.S.C. 154(b) by 0 days.

(21) Appl. No.: 09/513,933

(22) Filed: Feb. 28, 2000

Related U.S. Application Data

(60) Continuation-in-part of application No. 09/240,929, filed on Jan. 29, 1999, now abandoned, which is a division of application No. 08/596,967, filed on Feb. 5, 1996, now Pat. No. 5,775,145.

(51) Int. Cl.[7] ..... E05B 33/00; E05B 3/36

(52) U.S. Cl. ..... 109/73; 70/367; 70/368; 70/369; 70/379 R; 70/380; 109/74; 312/326

(58) Field of Search ..... 109/73, 74; 312/326, 312/329; 70/367–369, DIG. 57, 79, 80, 379 R, 379 A, 380, 370, 371

(56) References Cited

U.S. PATENT DOCUMENTS

| | | | | |
|---|---|---|---|---|
| 406,848 | * | 7/1889 | Mosler et al. | 109/74 |
| 746,106 | * | 12/1903 | Krog | 312/329 |
| 2,008,668 | * | 7/1935 | Gold | 70/368 |
| 2,218,372 | * | 10/1940 | Ackerman | 16/374 |
| 2,284,320 | * | 5/1942 | Howe | 49/383 |
| 2,284,921 | | 6/1942 | Purkiss | 292/302 |
| 2,300,405 | * | 11/1942 | Cook | 312/329 |
| 2,387,172 | * | 10/1945 | Mosler et al. | 109/74 |
| 2,568,592 | | 9/1951 | O'Connor | 292/87 |
| 2,578,610 | * | 12/1951 | Stone | 312/329 X |
| 2,587,355 | | 2/1952 | McEwan . | |
| 2,595,473 | | 5/1952 | O'Connor | 70/79 |
| 2,645,743 | * | 7/1953 | De Smidt | 312/329 |
| 2,651,559 | * | 9/1953 | O'Connor | 312/329 |
| 2,740,284 | * | 4/1956 | Gray | 70/79 |
| 2,852,926 | * | 9/1958 | Cherrenka | 70/79 |
| 2,953,011 | * | 9/1960 | Sitler | 70/80 |
| 3,400,562 | * | 9/1968 | Bloss | 70/70 |
| 3,410,123 | * | 11/1968 | Jacobi | 70/368 |
| 3,612,592 | | 10/1971 | Reitzel | 292/302 X |
| 3,722,240 | * | 3/1973 | Spain et al. | 70/378 X |
| 4,007,613 | * | 2/1977 | Gassaway | 70/DIG. 57 X |
| 4,145,978 | * | 3/1979 | Johnson et al. | 109/64 X |
| 4,186,460 | * | 2/1980 | Artman | 16/374 X |
| 4,539,828 | * | 9/1985 | Teleky | 70/369 |
| 4,704,970 | * | 11/1987 | Sanderson et al. | 109/74 X |
| 4,748,716 | * | 6/1988 | Bentz et al. | 16/374 X |
| 5,104,164 | * | 4/1992 | Sieg | 70/369 X |
| 5,280,755 | * | 1/1994 | Batur | 109/74 X |
| 5,544,595 | * | 8/1996 | Stephenson, III et al. | 109/73 X |
| 5,753,897 | | 5/1998 | Kasper | 235/380 |
| 5,775,145 | | 7/1998 | Kasper | 70/367 |
| 5,971,515 | * | 10/1999 | Baker et al. | 109/74 X |

FOREIGN PATENT DOCUMENTS

| | | | | |
|---|---|---|---|---|
| 369380 | * | 6/1963 | (CH) | 312/329 |
| 4008649 | * | 9/1991 | (DE) | 70/368 |
| 2614065 | * | 10/1988 | (FR) | 49/383 |
| 72087 | | 9/1929 | (SE) | 292/302 |

* cited by examiner

*Primary Examiner*—Lloyd A. Gall
(74) *Attorney, Agent, or Firm*—Kriegsman & Kriegsman

(57) ABSTRACT

A cabinet includes a top panel, a first side panel, a second side panel, a rear panel, an interior base panel and a door which together define an interior cavity. The cabinet also includes a hinge assembly for hingedly connecting the door to the first side panel so as to enable the door to pivot between a closed position and an open position. The hinge assembly includes a bracket coupled to the interior surface of the first side panel and a butt hinge coupled to the bracket and to the interior surface of the door. The butt hinge includes a first leaf which is fixedly secured onto the bracket and a second leaf which is fixedly secured onto the interior surface of the door, the first and second leaves being capable of independent rotation about a pivot bar.

5 Claims, 19 Drawing Sheets

CABINET HAVING A LOCK ASSEMBLY

CROSS-REFERENCE TO RELATED APPLICATIONS

This application is a continuation-in-part of U.S. patent application Ser. No. 09/240,929 now abandoned, which was file on Jan. 29, 1999 in the name of Kazmier J. Kasper, which, in turn, is a divisional of Ser. No. 08/596,967 which was filed on Feb. 5, 1996 U.S. Pat. No. 5,775,145, in the name of Kazmier J. Kasper.

BACKGROUND OF THE INVENTION

The present invention relates generally to cabinets and more particularly to lockable cabinets.

Devices for dispensing articles are well known and widely used in commerce. Such devices are commonly used to dispense tickets, such as lottery tickets, and/or cards, such as phone cards.

In U.S. Pat. No. 5,753,897 to K. J. Kasper, there is disclosed an apparatus for dispensing articles such as tickets and cards which includes a cabinet and a plurality of article dispensing assemblies inside the cabinet. Each article dispensing assembly includes a base and a frame for enclosing the articles to be dispensed in a stack. The bases are mounted on a pair of vertical support plates. A gate is disposed behind each frame for receiving articles from its associated frame and allowing only one article at a time to pass through. A toothed blade is disposed underneath each frame and a motor driven rack and pinion is coupled to the toothed blade for bringing the toothed blade into engagement with the lowermost article in the stack, moving said toothed blade so that the lowermost article is transported from the stack into the gate, bringing the toothed blade out of engagement with the article and then moving the toothed blade back to engage the next article in the stack. In one embodiment of the invention each frame is hingedly mounted on its base. In another embodiment of the invention each frame is hingedly and lockably mounted on its base and in still another embodiment of the invention, which is intended especially for use with cards which include an integrated circuit chip onto which information can be written into and read off of, each article dispensing assembly includes a read/write head assembly underneath its frame for reading information off of the chip on the card at the bottom of the stack and/or writing information onto the chip on the card at the bottom of the stack.

Devices for dispensing articles of the type described above are often housed within a security cabinet to prevent theft and/or tampering of the articles to be dispensed thereby.

Security cabinets used to house article dispensing devices are commonly equipped with a lock assembly for locking the door of the cabinet in a closed position, thereby precluding the cabinet from being opened by unauthorized personnel, which is highly desirable. Typically, the lock assembly requires a unique key to be used to unlock the security cabinet.

One type of lock assembly which is well known and widely used in the art utilizes a double lock type arrangement. Specifically, the lock assembly comprises a key operated plug which is removably mounted in a shell. The lock assembly also comprises an attachment device, such as a bolt or screw, which is positioned behind and spaced apart from the shell, the attachment device being mounted on some type of plate. In the operation of such a lock assembly, the plug is first removed using a unique security key. After the plug has been removed, a screwdriver or wrench is then inserted through the bore in the shell and is used to unscrew the attachment device. Once the attachment device has been unscrewed, the door can be opened.

Lock assemblies of the type described above are well known in the art and are widely used in high security applications. In particular, lock assemblies of the type described above are commonly used in vending machines, currency changers, automatic bank tellers or any other similar application where it is desirable to lock the access door of a cabinet, box or other similar device.

Although well known and widely used in commerce, lock assemblies of the type described above suffer a couple notable drawbacks.

As a first drawback, lock assemblies of the type described above are time consuming and labor intensive to use. Specifically, it has been found that the secondary unlocking process in which a screwdriver or wrench is inserted through the bore in the shell and is used to unscrew the attachment device is time consuming and difficult to perform.

As a second drawback, lock assemblies of the type described above are relatively insecure. Specifically, it has been found that the secondary unlocking process in which the attachment device unscrewed can be accomplished using any conventional screwdriver or wrench. As a consequence, once the plug has been removed from the shell, any unauthorized person can use a screwdriver or wrench to access the items contained within the cabinet.

SUMMARY OF THE INVENTION

It is an object of the present invention to provide a new and improved lock assembly.

It is another object of the present invention to provide a new and improved cabinet.

It is yet another object of the present invention to provide a new and improved locking system.

It is still another object of the present invention to provide a new and improved lock assembly of the type having a shell and a removable plug.

It is yet still another object of the present invention to provide a new and improved hinge assembly for connecting a door to a wall of a cabinet.

It is a further object of this invention to provide a locking system that is difficult to pick.

Accordingly, there is provided a lock assembly comprising a shell having a front end, a rear end, and a central bore extending from the front end to the rear end, a key operated plug axially aligned and rotatably and removably disposed within the central bore of said shell, a cam module rotatably mounted on the rear end of the shell, a key insertable into said plug for removing said plug from said shell, and a tool insertable through the central bore in said shell when said key operated plug is removed from said shell for rotationally engaging and moving said cam module relative to said shell.

According to one feature of the invention, the cam module includes a movable bracket for restricting rotational movement of the cam module relative to the shell.

According to another feature of the invention, there is provided a cabinet comprising a housing having a wall, a door, a hinge assembly for hingedly connecting said door to said wall and a locking system for locking said door in a closed position, said locking system including a lock assembly, said lock assembly comprising a shell having a front end, a rear end, and a central bore extending from the front end to the rear end, a key operated plug axially aligned and rotatably and removably disposed within the central bore of said shell, a cam module rotatably mounted on the rear end of the shell, a key insertable into said plug for removing said plug from said shell, a tool insertable through the central bore in said shell when said key operated plug is removed from said shell for engaging and rotationally moving said cam module relative to said shell, a latch fixedly mounted in said door, a movable plate having a slot and a bracket assembly for connecting said lock assembly to said movable plate having a slot.

According to still another feature of this invention there is provided a hinge assembly for connecting the door of the cabinet to the wall of the cabinet, the hinge assembly comprising a hinge having two leaves, one leaf being fixedly secured to the door and a bracket connected at one end to the other one of the leaves and at the other end to the wall.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts:

FIG. 1(*a*) is a section view of the lock shown in FIG. 1, but assembled;

FIG. 1(*b*) is an exploded perspective view of the cam module shown in FIG. 1;

FIG. 5(*a*) is side view of the plug and tool shown in FIG. 1, illustrating the size of the plug relative to tool;

DETAILED DESCRIPTION OF A PREFERRED EMBODIMENT

Figure 1:
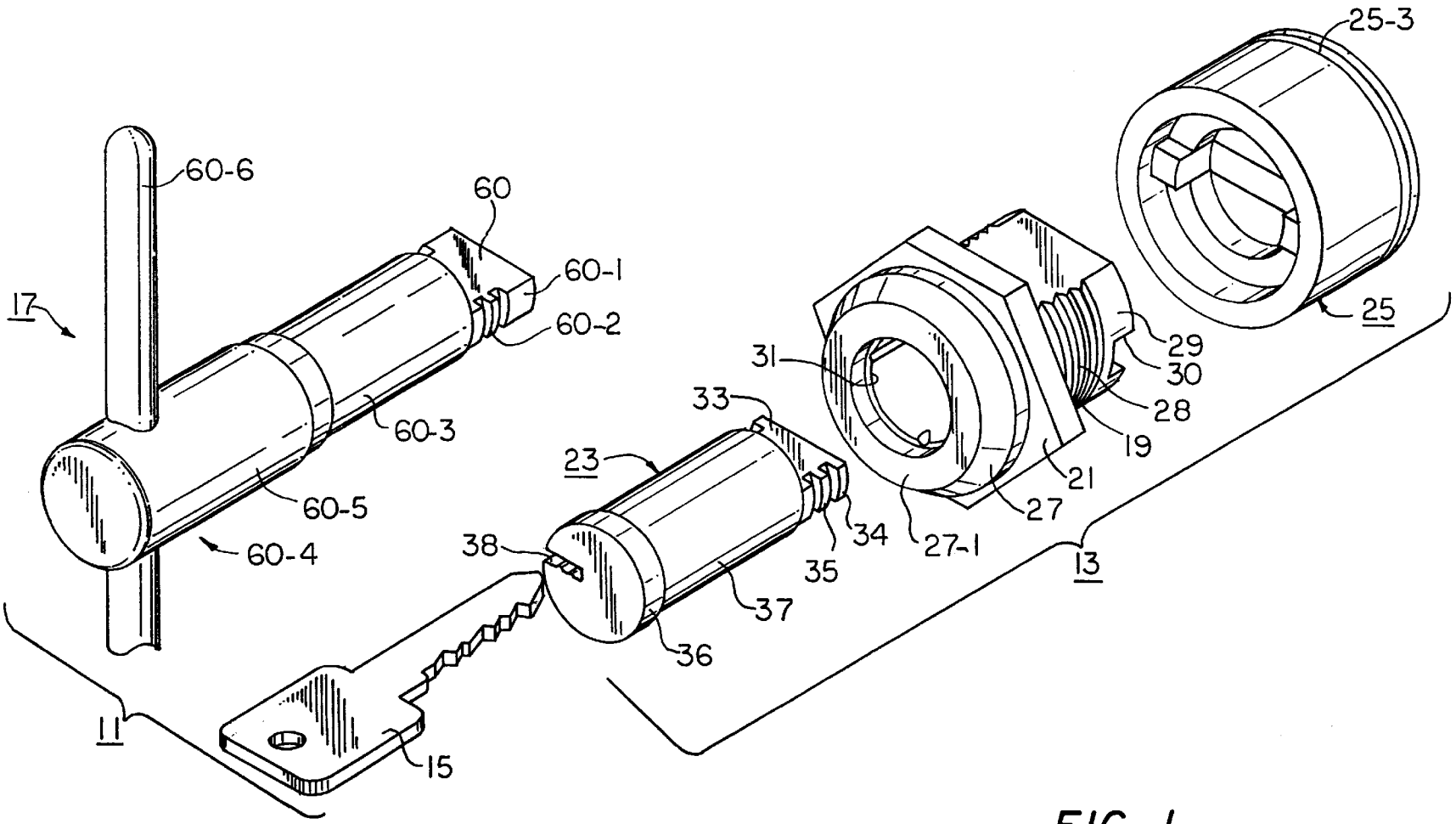
FIG. 1 is an exploded perspective view of a lock assembly constructed according to the teachings of the present invention, the lock assembly including a key, a tool and a lock, the lock including a plug, a shell and a cam module.
Figures 1A, 1B:
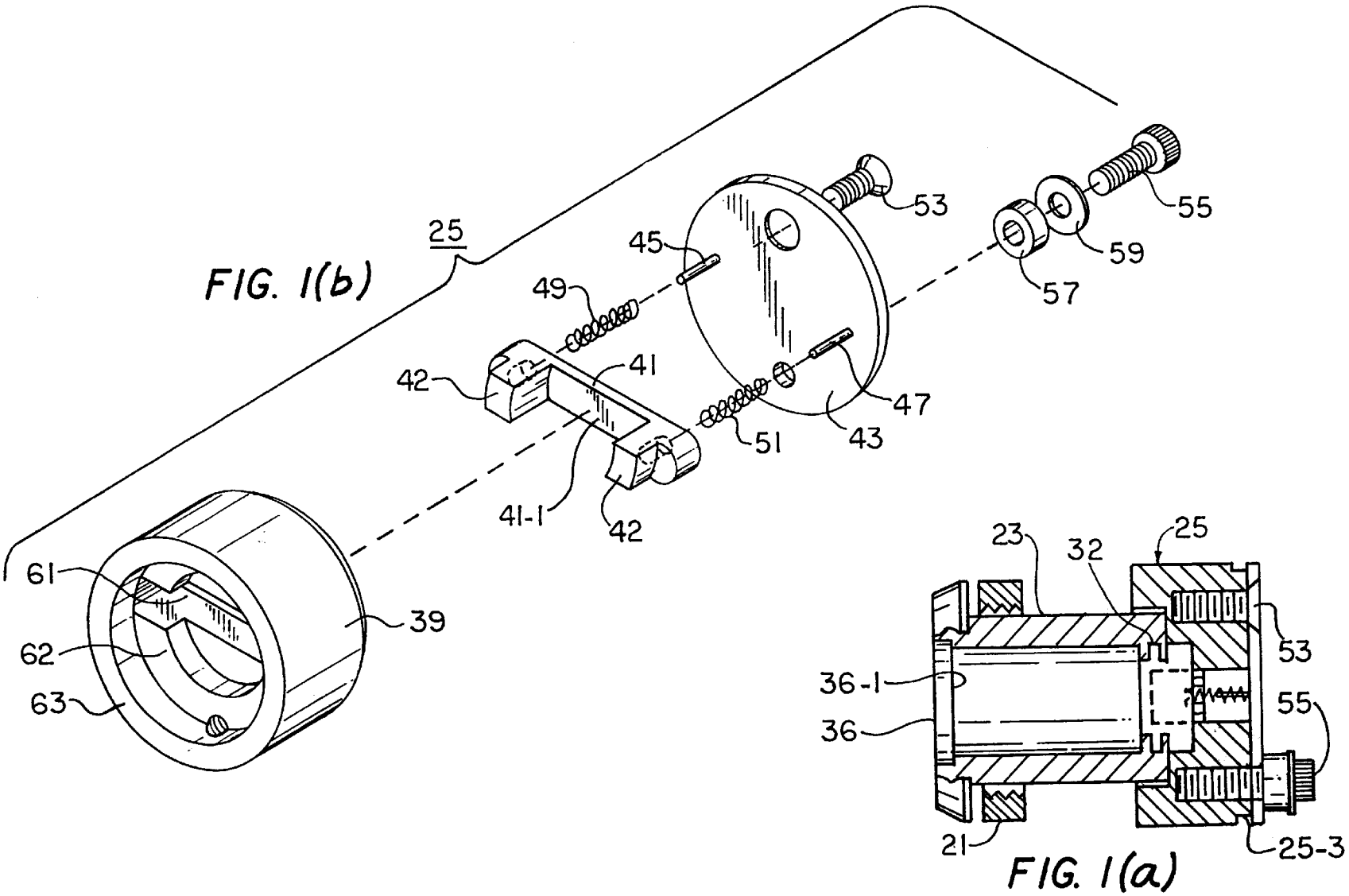

Referring now to the drawings, and first to FIG. 1, there is shown a lock assembly constructed according to the teachings of the present invention, the lock assembly being represented generally by reference numeral 11.

Lock assembly 11 includes a lock 13, a key 15 and a tool 17.

Lock 13, which is also shown in section view in assembled form in FIG. 1(*a*), includes a shell 19, a nut 21, a key operated plug 23 and a cam module 25. Cam module 25 is also shown in exploded perspective view in FIG. 1(*b*).

Key 15 is used as a primary locking device to rotate plug 23 in shell 19 between a locked position in which plug 23 cannot be removed from shell 19 and an unlocked position in which plug 23 can be removed from shell 19. Tool 17 is used as a secondary locking device to rotate cam module 25 relative to shell 19 for a purpose to be subsequently explained.

Shell 19 is a generally cylindrical member having a front end 27, an externally threaded main body portion 28, a rear end 29 which includes a lateral slot 30, a central bore 31 extending from front end 27 to rear end 29 and an internal groove 32 on central bore 31 at rear end 29.

Nut 21 is sized to screw onto main body portion 28 of shell 19 and is used to secure shell 19 to the wall of a cabinet on which it is to be mounted, as will hereinafter be explained.

Plug 23 is a generally cylindrically shaped member having a generally rectangular shaped front end 33 which includes a pair of ridges 34 and 35, a rear end 36, a main body portion 37, and a keyway 38, keyway 38 extending from one end of plug 23 to the other. Plug 23 is sized and shaped so that it can be axially aligned and rotatably and removably disposed in bore 31 of shell 19. Front end 33 of plug 23 is sized so that it can extend up into lateral slot 30 in shell 19.

Plug 23 is disposed into shell 19 in the following manner. First, key 15 is inserted into keyway 38. Then, plug 23 is pushed into bore 31 in shell 19 until surface 36-1 of rear end 36 abuts against surface 27-1 on front end 27 of shell 19. When so positioned, front end 33 will be disposed in slot 30 of shell 19 and ridge 35 will be aligned with internal groove 32. Plug 19 can then be rotated 90 degrees using key 15 until ridge 35 is disposed within groove 32, thereby locking plug 23 inside shell 19. Key 15 can then be removed with plug 23 lockably disposed within shell 19. In order to unlock and remove plug 23 from shell 19, the procedure is reversed. It should be noted that key 15 cannot be withdrawn from plug 23 unless plug 23 is locked in shell 19.

Plug 23 and key 15 may be a plug, key combination such as shown in U.S. Pat. No. 4,635,455.

Cam module 25 includes a cam module base 39, a cam module bracket 41, a cam module cover plate 43, a pair of pins 45 and 47, a pair of springs 49 and 51, a pair of bolts 53 and 55, a bearing 57 and a washer 59.

Bracket 41 has a main body portion 41-1 and a pair of feet 42.

Tool 17 has a front end 60 having a pair of ridges 60-1 and 60-2, a main body portion 60-3 and a handle 60-4 which includes a body 60-5 and a bar 60-6.

Cam module base 39 is rotatably and slidably mounted on front end 30 of shell 19 and includes a lateral slot 61. Pins 45 and 47 are fixedly mounted on cam module cover plate 43 which is fixedly attached to cam module base 39 by bolts 53 and 55. Bracket 41 is seated on pins 45 and 47 and is slidably movable in slot 61. Springs 49 and 51 on pins 45 and 47 urge bracket 41 backward so that feet 42 project out of slot 61 beyond surface 62 on module 39, as shown in FIG. 1. A stop 63 on base 39 limits slidable movement of base 39 on front end 29 of shell 19. As long as feet 42 of bracket 41 extend out of slot 61 beyond surface 62 of base 39, cam module 25 cannot be rotated relative to shell 19. However, tool 17 is sized so that when it is inserted into and through shell 19 it will hit up against bracket 41 and, then, when tool 17 is pushed in further it will push bracket 41 back against the action of springs 49 and 51 so that feet 42 do not project up outside slot 61 beyond surface 62. When bracket 41 is so positioned, cam module 25 can be easily rotated relative to shell 19 by simply turning tool 17.

Figure 5:
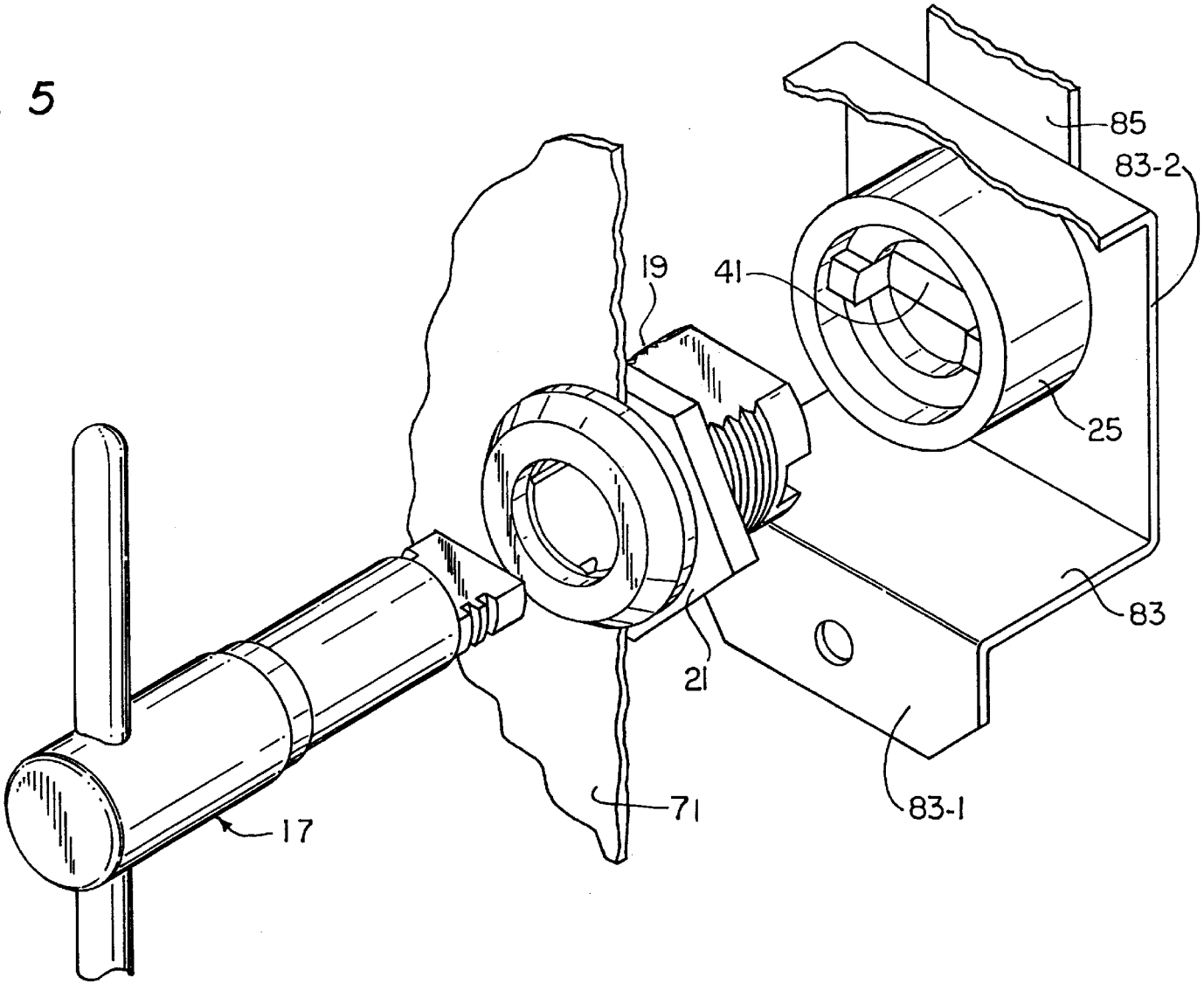
FIG. 5 is a partly exploded perspective view of the shell, cam module and key in FIG. 1 and related structure.
Figure 5A:
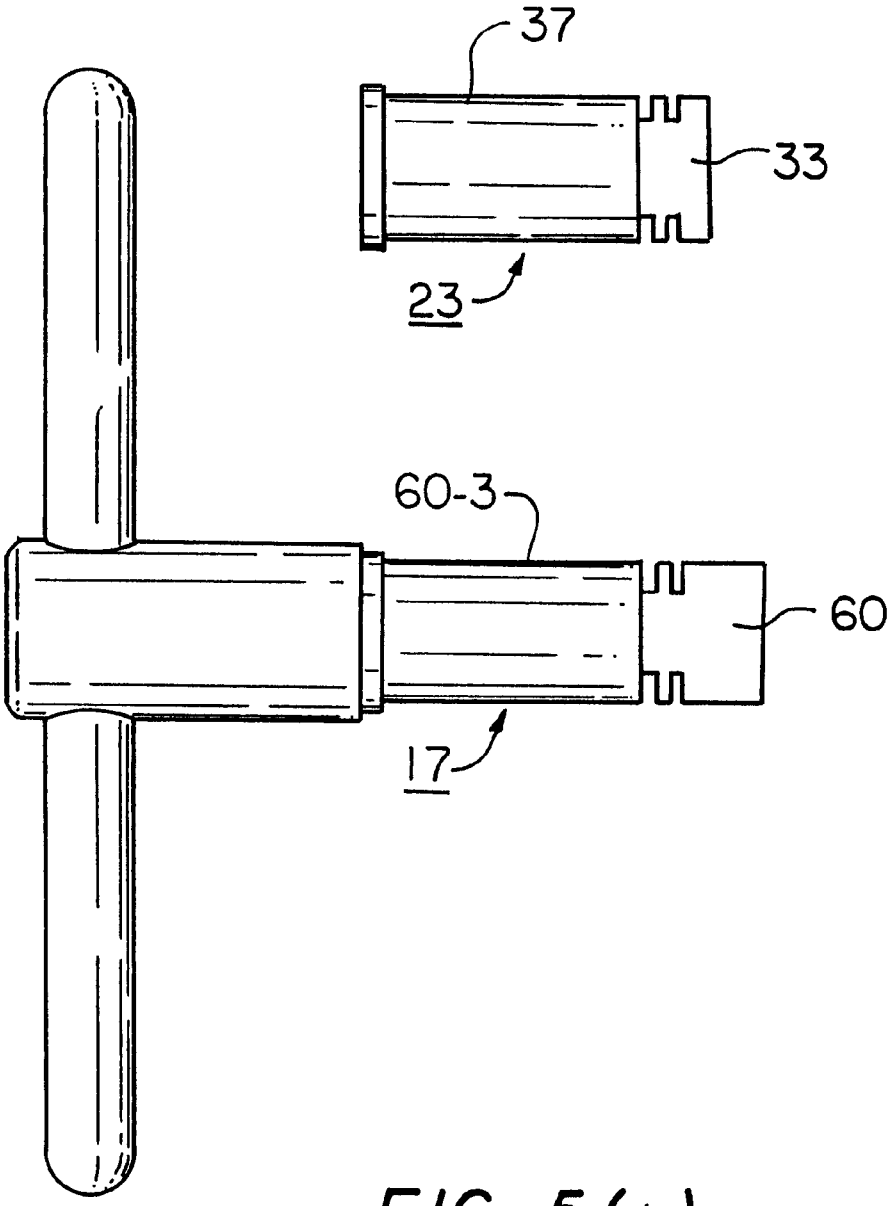
Figure 6:
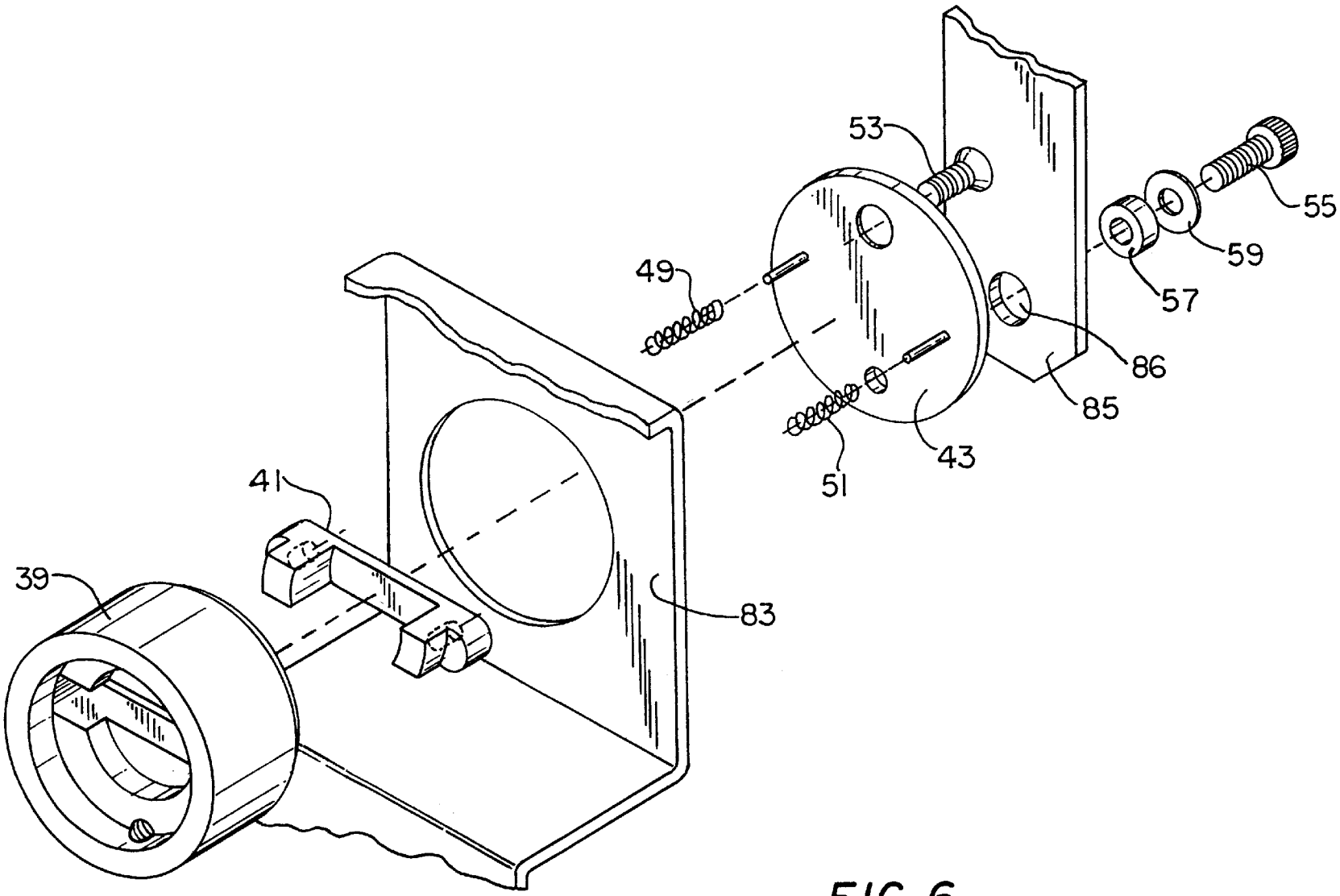
FIG. 6 is an exploded perspective view of the cam module in FIG. 1 and related structure.
Figure 7:
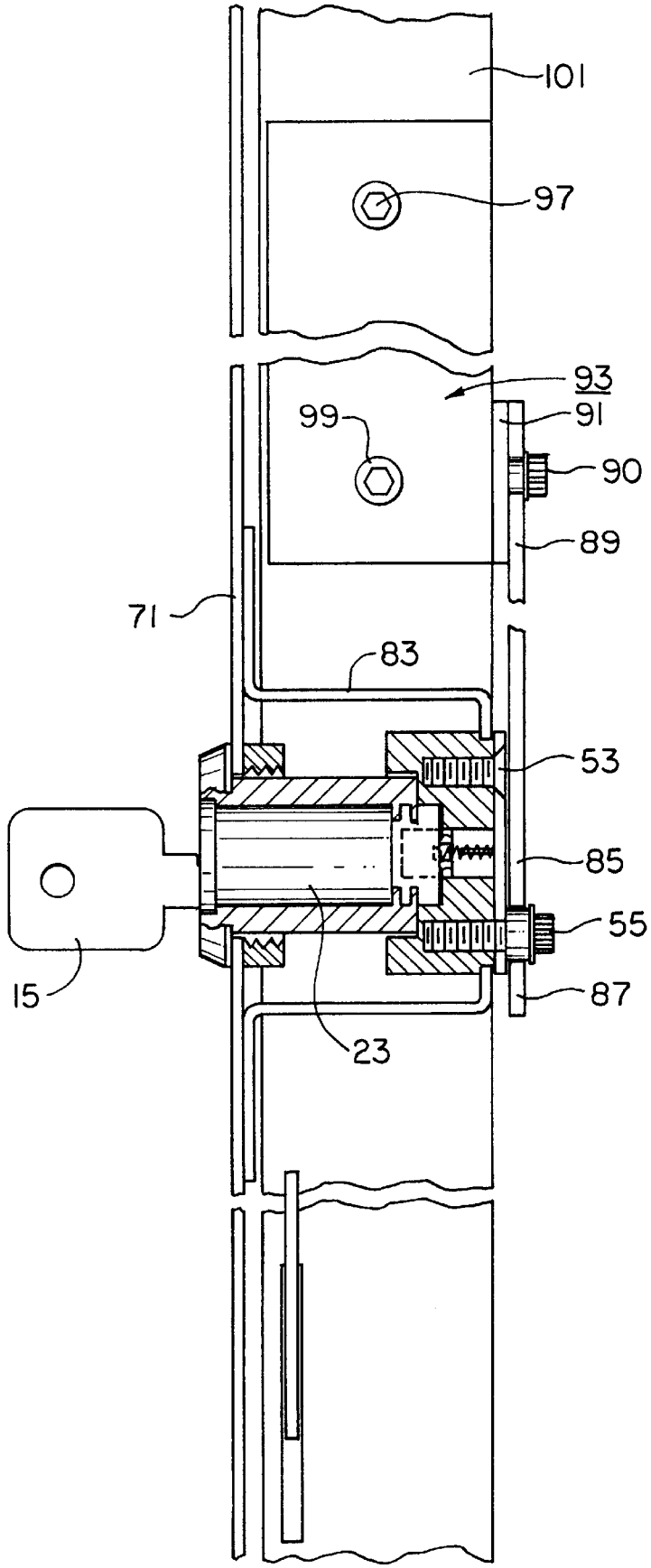
FIG. 7 is a view, partly in section, showing the shell and cam module in the lock assembly in FIG. 1 as mounted on the cabinet, with the plug in the shell and the key in the plug.
Figure 8:
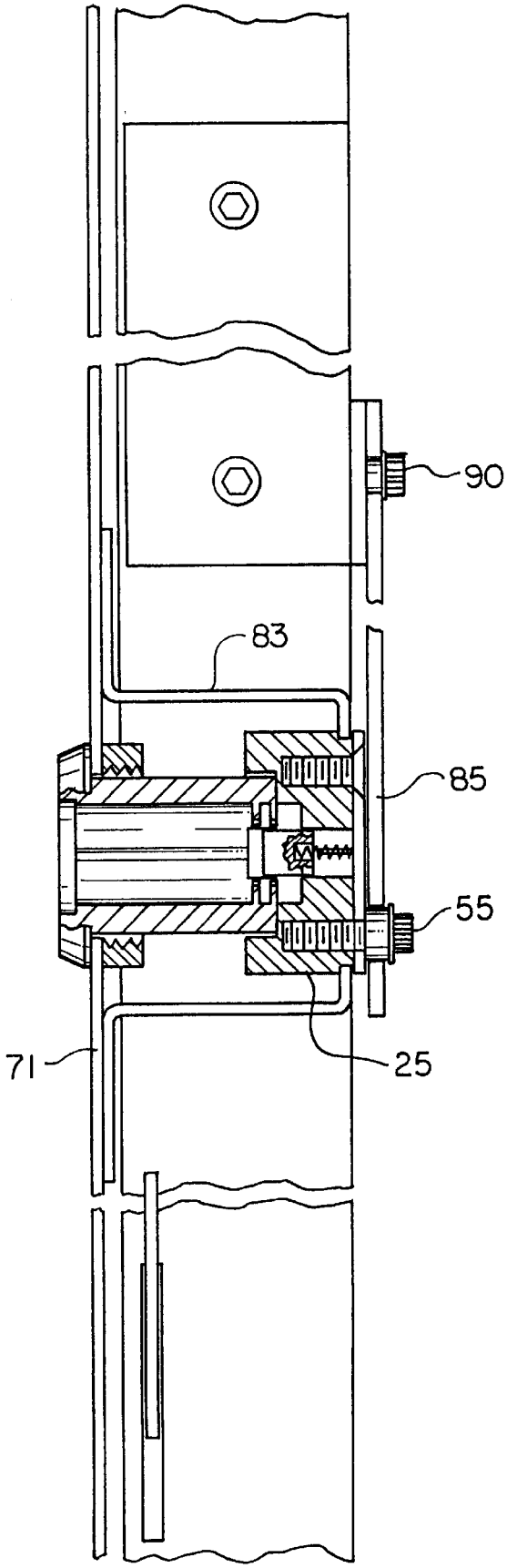
FIG. 8 is a view as shown in FIG. 7, after the plug inside the shell has been removed.

As can be seen in FIG. 5(*a*), the front end 60 of tool 17 is longer than the front end 33 of plug 23, while the front body portion 60-3 of tool 17 is identical to main body portion 37 of plug 23. Consequently, when plug 23 is inserted in shell 19, front end 33 will not hit up against bracket 41 thus tool 17 is the only way bracket 41 can be pushed back so that cam module can be rotated.

Figure 2:
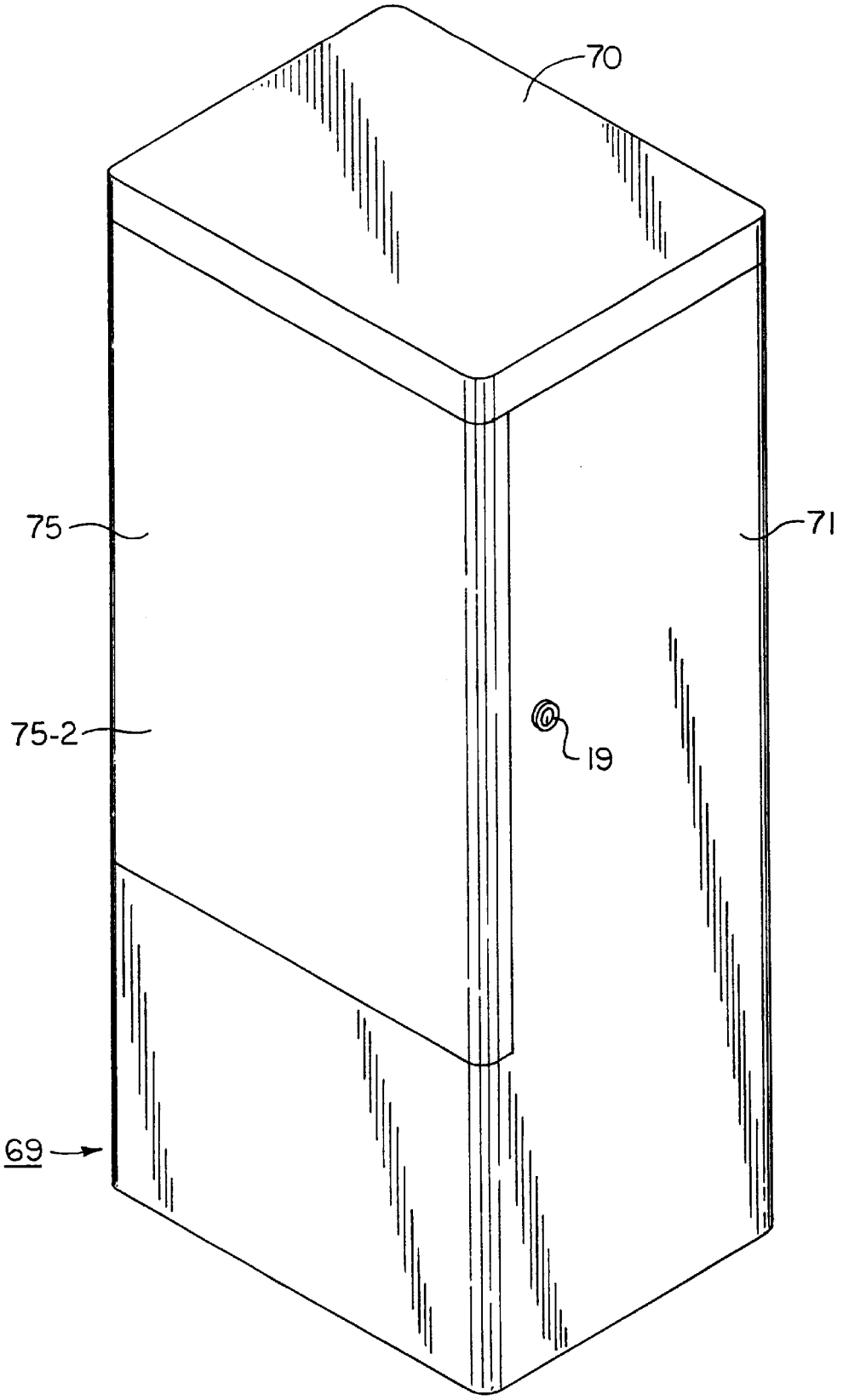
FIG. 2 is a perspective view of a first embodiment of a cabinet constructed according to the teachings of the present invention, the cabinet including a door and the lock of FIG. 1 for locking the door, the door being in a closed position.
Figure 3:
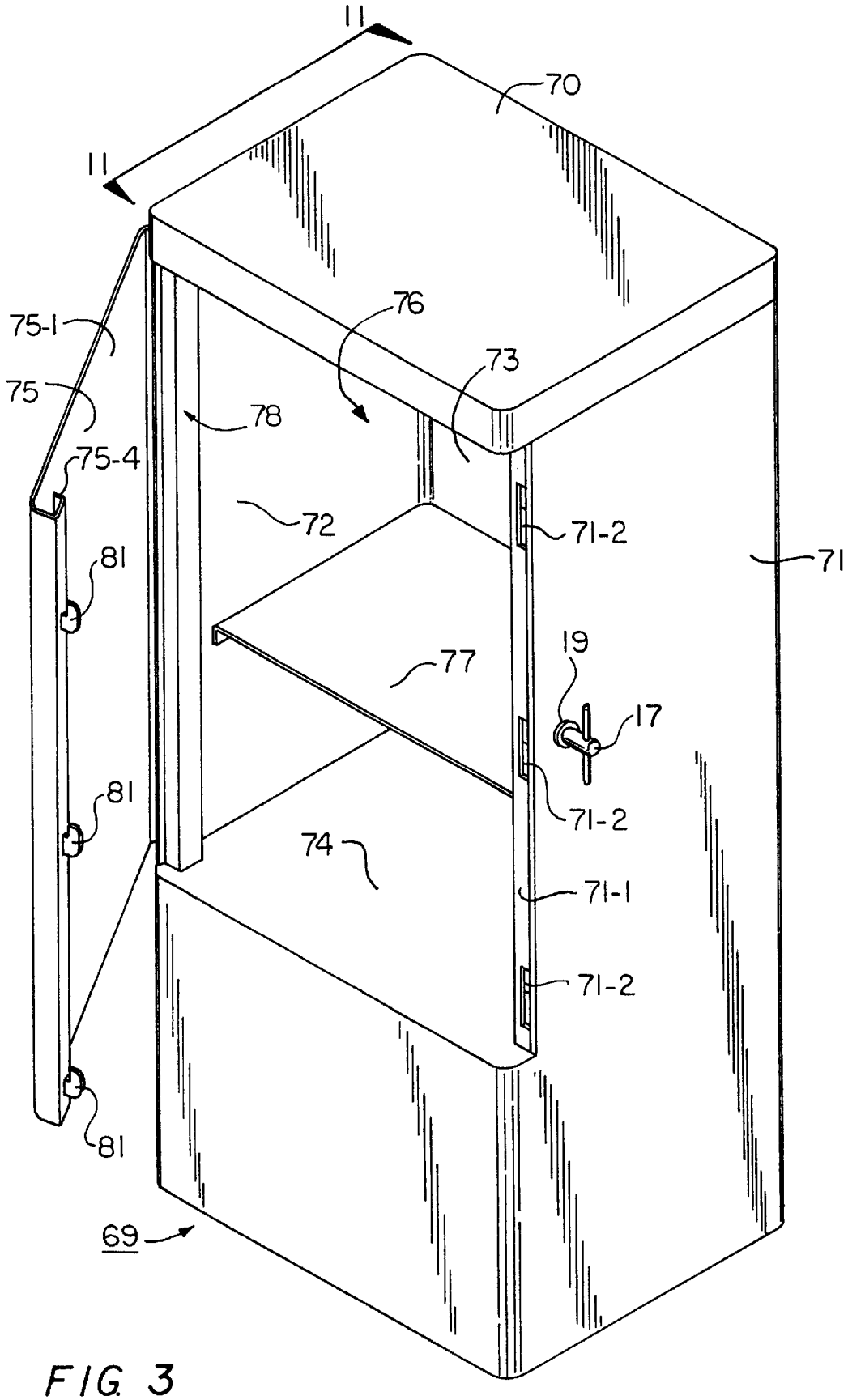
FIG. 3 is a perspective view of the cabinet shown in FIG. 2, but with the door in an open position and the tool in FIG. 1 in the shell of the lock in FIG. 1.

Referring now to FIGS. 2 and 3, there is shown a first embodiment of a cabinet constructed according to the teachings of the present invention, the cabinet being represented generally by reference numeral 69. As can be appreciated, cabinet 69 is designed to enable objects, such as a card dispensing apparatus, to be lockably disposed therewithin for security purposes.

Cabinet 69 is a generally hollowed out, rectangular member constructed of a rigid and durable material, such as steel. Cabinet 69 comprises a top panel 70, a pair of side panels 71 and 72 , a rear panel 73, an interior base panel 74 and a door 75. Top panel 70, side panels 71 and 72, rear panel 73, interior base panel 74 and door 75 together define an interior cavity 76 which is sized and shaped to house the desired object. A horizontal platform 77 is shown mounted onto side panels 71 and 72 in interior cavity 76. However, it is to be understood that platform 77 is not essential to the construction of cabinet 69 and as a consequence could be removed therefrom without departing from the spirit of the present invention.

Door 75 is a generally rectangular member and comprises an interior surface 75-1, an exterior surface 75-2, a first side edge 75-3 which is generally L-shaped in configuration and a second side edge 75-4 which is generally U-shaped in configuration. First side edge 75-3 of door 75 is pivotally mounted onto side panel 72 by a hinge assembly 78. As will be described further in detail below, door 75 is capable of rotation between a closed position, as shown in FIG. 2, and an open position, as shown in FIG. 3. In addition, as will be described further in detail below, door 75 is capable of being locked in its closed position using lock assembly 11.

Figure 13:
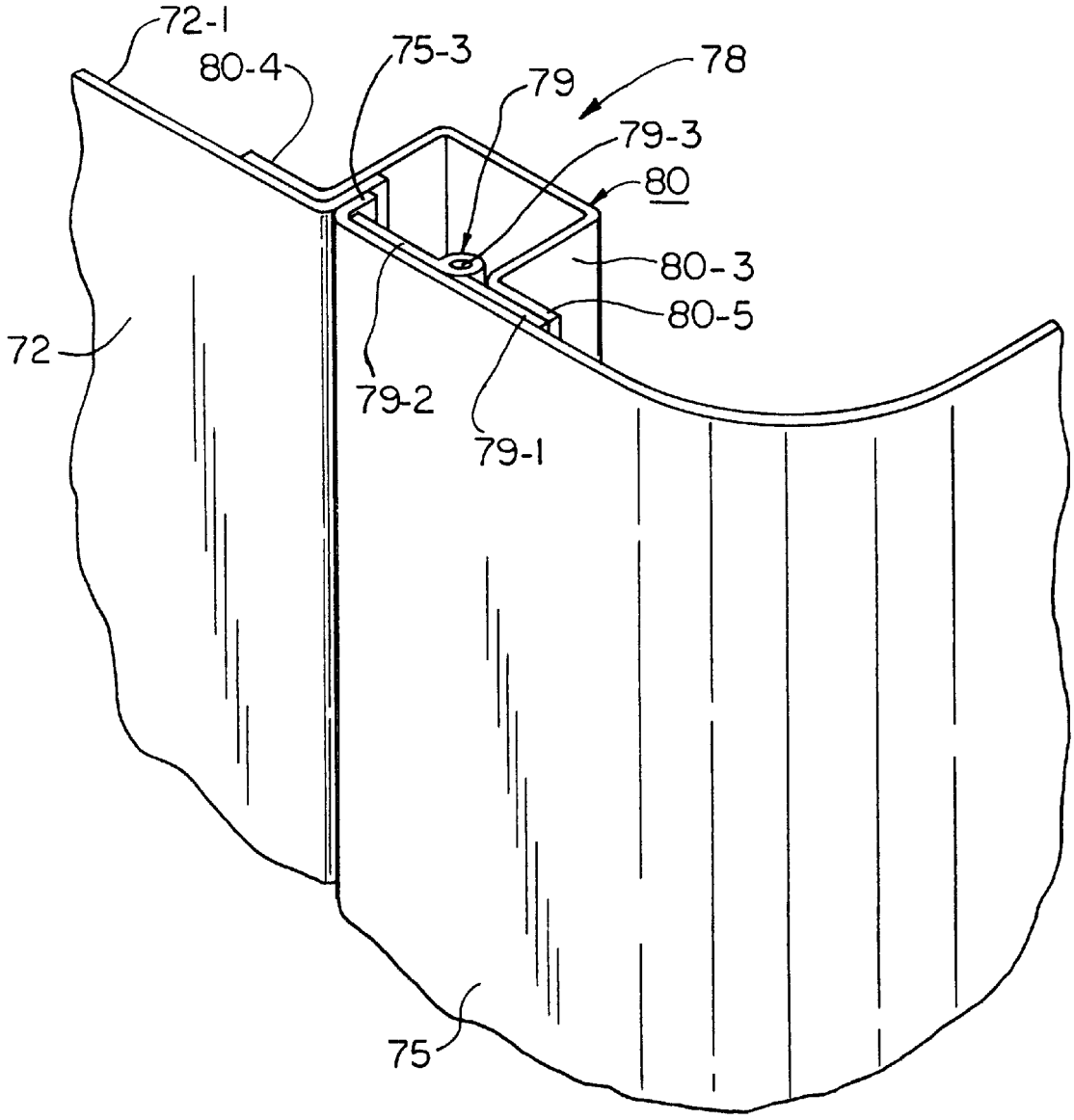
FIG. 13 is a fragmentary perspective view of a hinge assembly shown in FIG. 7.
Figure 14:
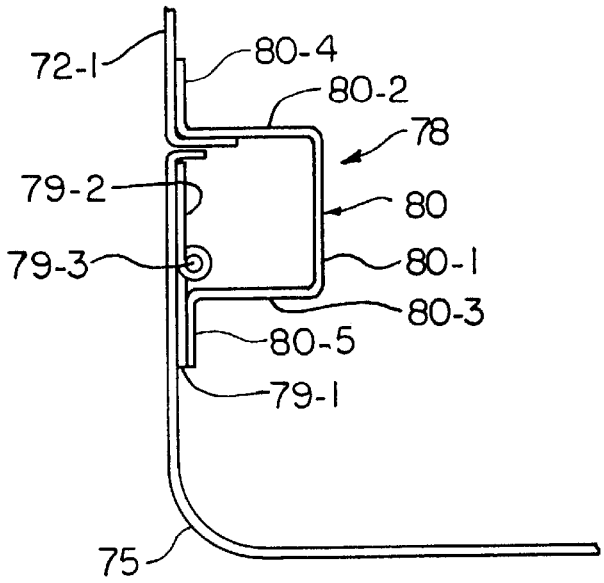
FIG. 14 is a top plan view of the hinge assembly shown in FIG. 13 when the door is in the closed position.
Figure 15:
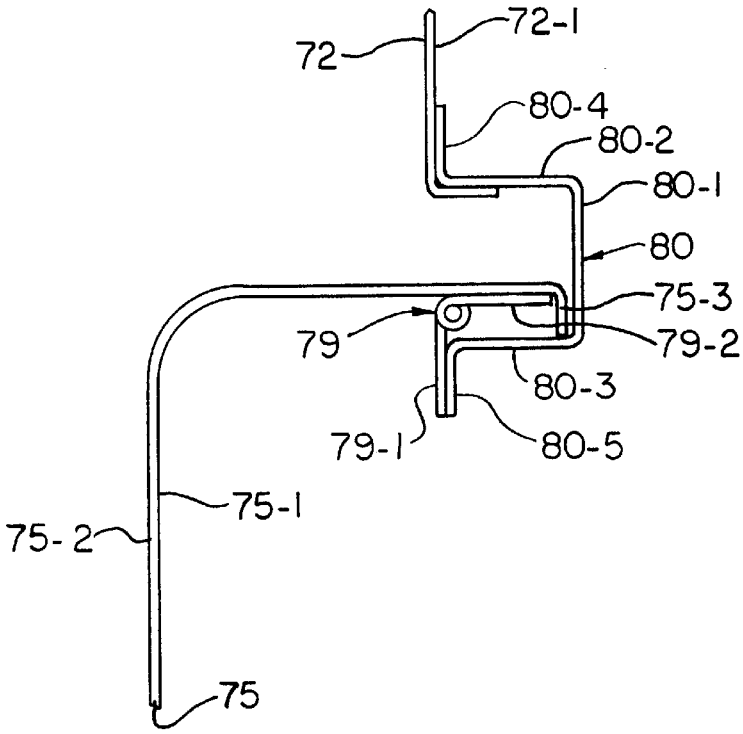
FIG. 15 is a top plan view of the hinge assembly shown in FIG. 14 when the door is in an open position.
Figure 16:
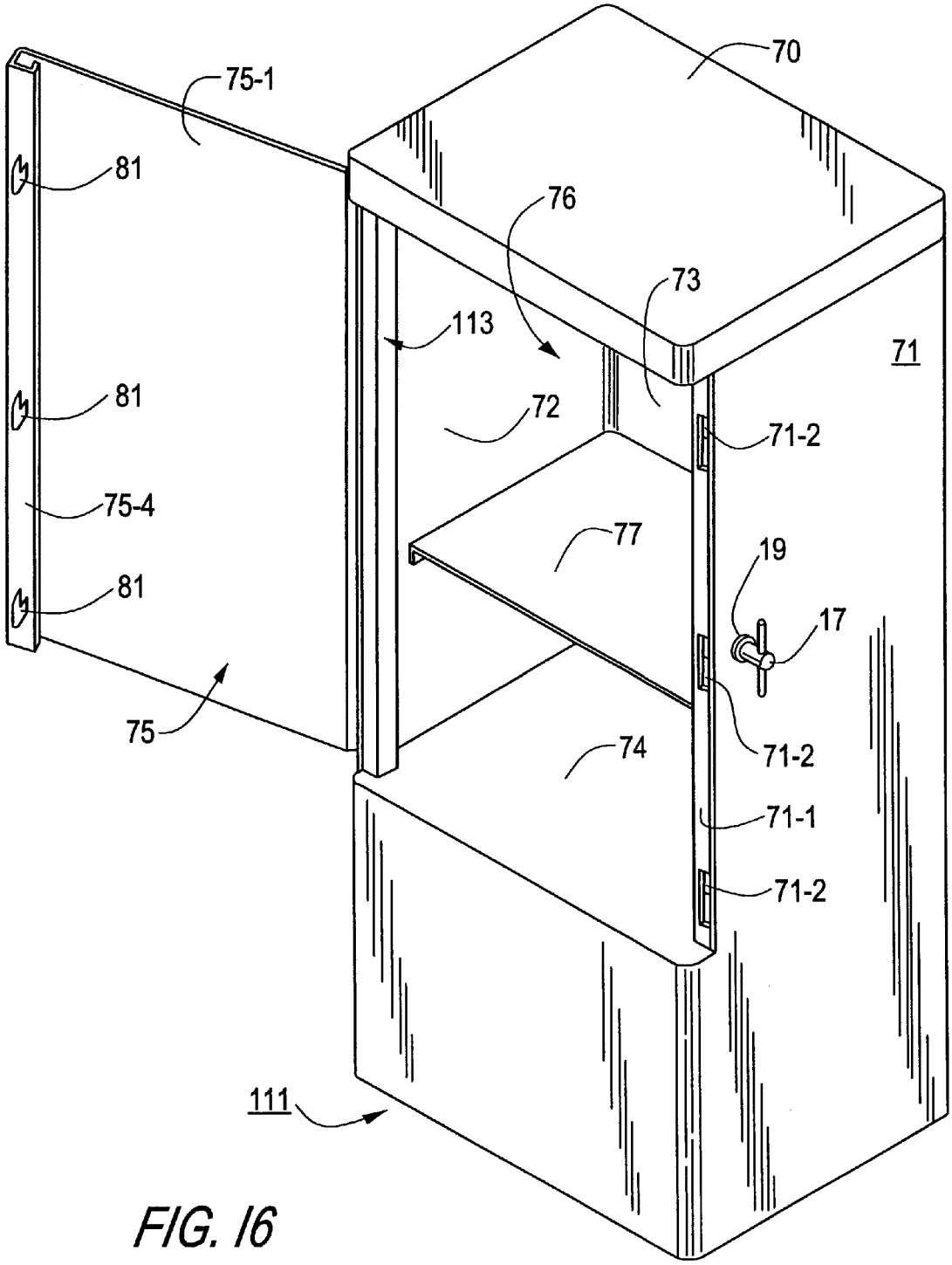
FIG. 16 is a perspective view of a second embodiment of a cabinet constructed according to the teachings of the present invention, the cabinet including a door and the lock of FIG. 1 for locking the door, the door being shown in an open position and the tool in FIG. 1 being shown disposed in the shell of the lock in FIG. 1.

Referring now to FIGS. 13–15, hinge assembly 78 comprises an elongated butt hinge 79 and an elongated bracket 80.

Butt hinge 79 is preferably constructed of a rigid and durable material and comprises a first leaf 79-1 and a second leaf 79-2. First and second leaves 79-1 and 79-2 are generally rectangular in shape and are capable of independent rotation about an elongated pivot bar 79-3.

Bracket 80 is preferably a hat section bracket constructed of a rigid and durable material. Specifically, bracket 80 preferably comprises a base 80-1 which is generally rectangular. Bracket 80 also comprises first and second legs 80-2 and 80-3 which extend orthogonally out from opposite ends of base 80-1. Bracket 80 further comprises first and second flanges 80-4 and 80-5 which extend orthogonally out from first and second legs 80-2 and 80-3, respectively, in opposite directions away from one another.

First flange 80-4 of bracket 80 is fixedly mounted onto an interior surface 72-1 of side panel 72 by any suitable means, such as by an adhesive or through welding. Additionally, second flange 80-5 of bracket 80 is fixedly mounted onto first leaf 79-1 of butt hinge 79 by any suitable means, such as by an adhesive or through welding. Furthermore, second leaf 79-2 of butt hinge 79 is fixedly mounted onto interior surface 75-1 of door 75 at first side edge 75-3 by any suitable means, such as by an adhesive or through welding.

As such, door 75 is capable of rotation between its open position and its closed position in the following manner. With first leaf 79-1 of butt hinge 79 fixedly mounted onto second flange 80-5 of bracket 80, second leaf 79-2 can be rotated about elongated pivot bar 79-3 until it is substantially coplanar with first leaf 79-1. Positioning second leaf 79-2 at approximately 180 degrees relative first leaf 79-1, in turn, disposes door 75 in its closed position, as shown in FIGS. 2, 13 and 14.

Rotation of door 75 in a clockwise direction, in turn, causes second leaf 79-2 to rotate in a clockwise direction relative elongated pivot bar 79-3. Door 75 is capable of clockwise rotation for approximately 90 degrees until first side edge 75-3 of door 75 abuts against second leg 80-3 of bracket 80, door 75 being considered in its open position with first side edge 75-3 in abutment against second leg 80-3, as shown in FIG. 15.

As a principal feature of the present invention, it should be noted that hinge assembly 78 acts as a hidden hinge because it is disposed entirely within interior cavity 76 of cabinet 69. Due to the hidden construction of hinge assembly 78, with door 75 locked in its closed position, hinge assembly 78 is inaccessible. Because hinge assembly 78 is inaccessible with door 75 locked in its closed position, hinge assembly 78 is incapable of being tampered or manipulated, thereby rendering cabinet 69 tamper proof, which is highly desirable.

Door 75 comprises a plurality of spaced apart latches 81. Each latch 81 comprises a hook 81-1 and a mounting plate 81-2, hook 81-1 being fixedly mounted onto its associated mounting plate 81-2 such as through welding. Hooks 81-1 are disposed to extend out through slots 81-3 formed in second side edge 75-4 of door 75. Mounting plates 81-2 are fixedly secured onto interior 75-1 of second side edge 75-4 of door 75 by bolts 82.

As shown in FIG. 3, side panel 71 of cabinet 69 comprises an inwardly protruding flange 71-1 having a plurality of spaced apart slots 71-2. As will be described further in detail below, each slot 71-2 is positioned to enable an associated hook 81-1 to project therethrough when door 75 is in its closed position.

Figure 11:
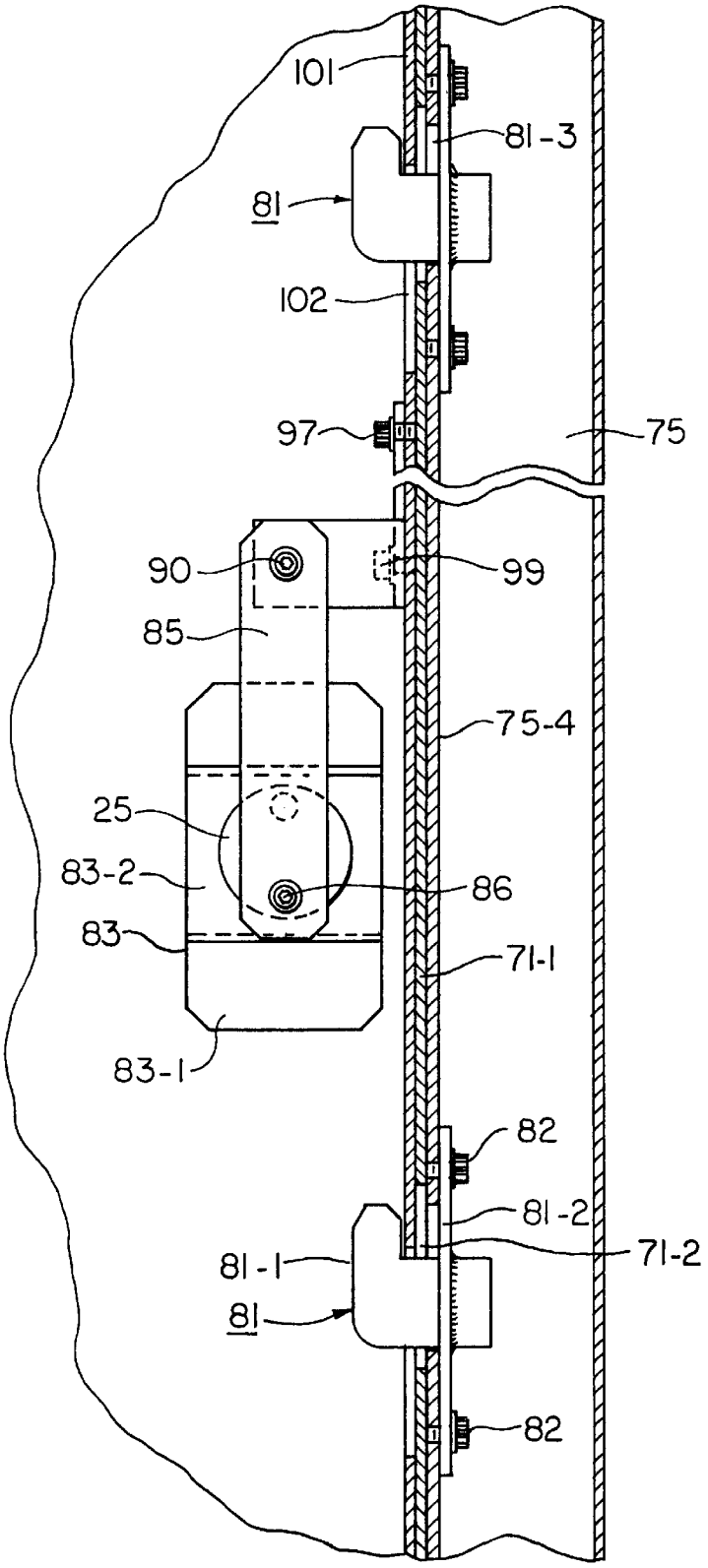
FIG. 11 is a section view, broken away in part, taken along lines 11—11 in FIG. 3.
Figure 12:
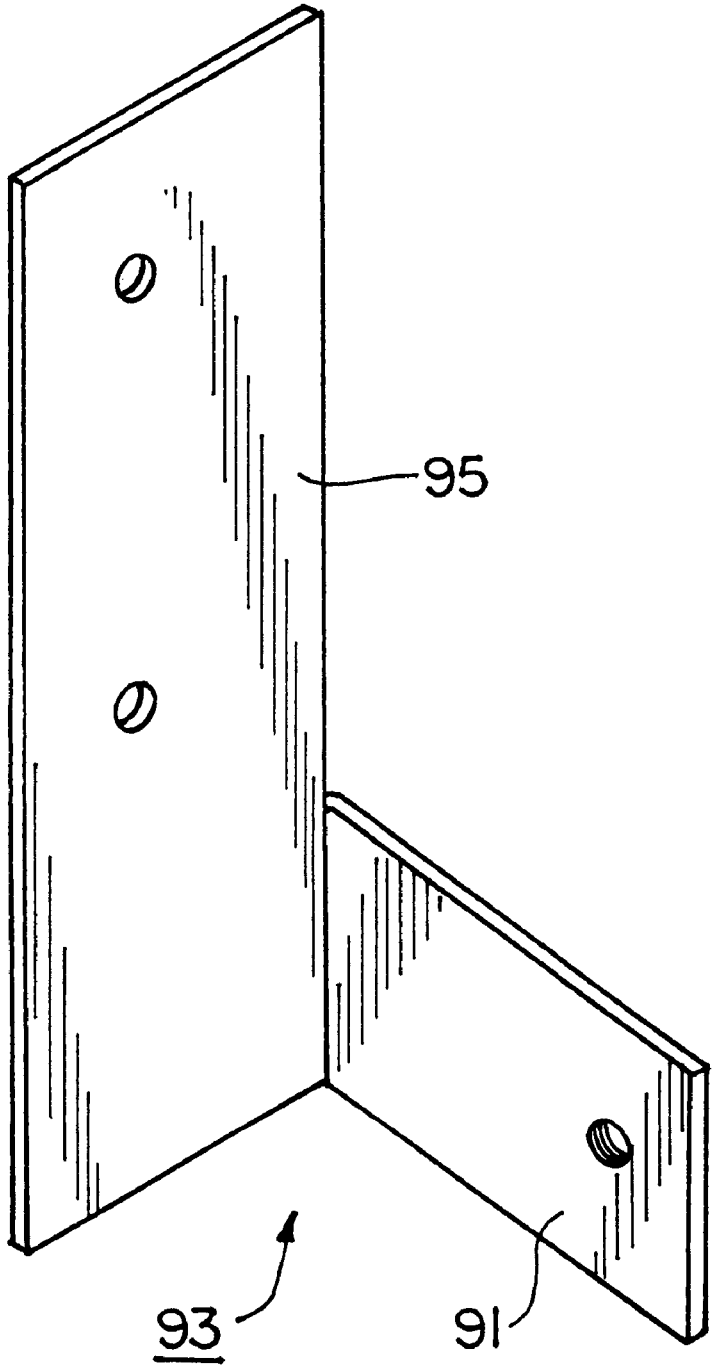
FIG. 12 is a perspective view of the interconnecting bracket shown in FIG. 7.

A first bracket 85 is fixedly mounted at one end 87 to cam module 25 by bolt 55 which extends through bearing 57 which is seated in a hole 86 in bracket 85. The other end 89 of bracket 85 is pivotally attached by a bolt 90 to a leg 91 of a second bracket 93. Main body portion 95 of bracket 93 is fixedly attached by bolts 97 and 99 to a slidably mounted elongated slide plate 101 having slots 102. Slide plate 101 is capable of being displaced between an upward position, in which door 75 is unlocked, and a downward position, in which door 75 is locked. Specifically, when door 75 is closed and unlocked, hooks 81-1 of latches 81 extend through slots 71-2 in flange 71-1 and through slots 102 in slide plate 101, as shown in FIG. 11. When door 75 is closed and locked, slide plate 101 is displaced downward so that hooks 81-1 of latches 81 are aligned against slide plate 101 rather than slots 102, as shown in FIG. 11, hooks 81-1 abutting against slide plate 101 to prevent door 75 from being opened.

Figure 4:
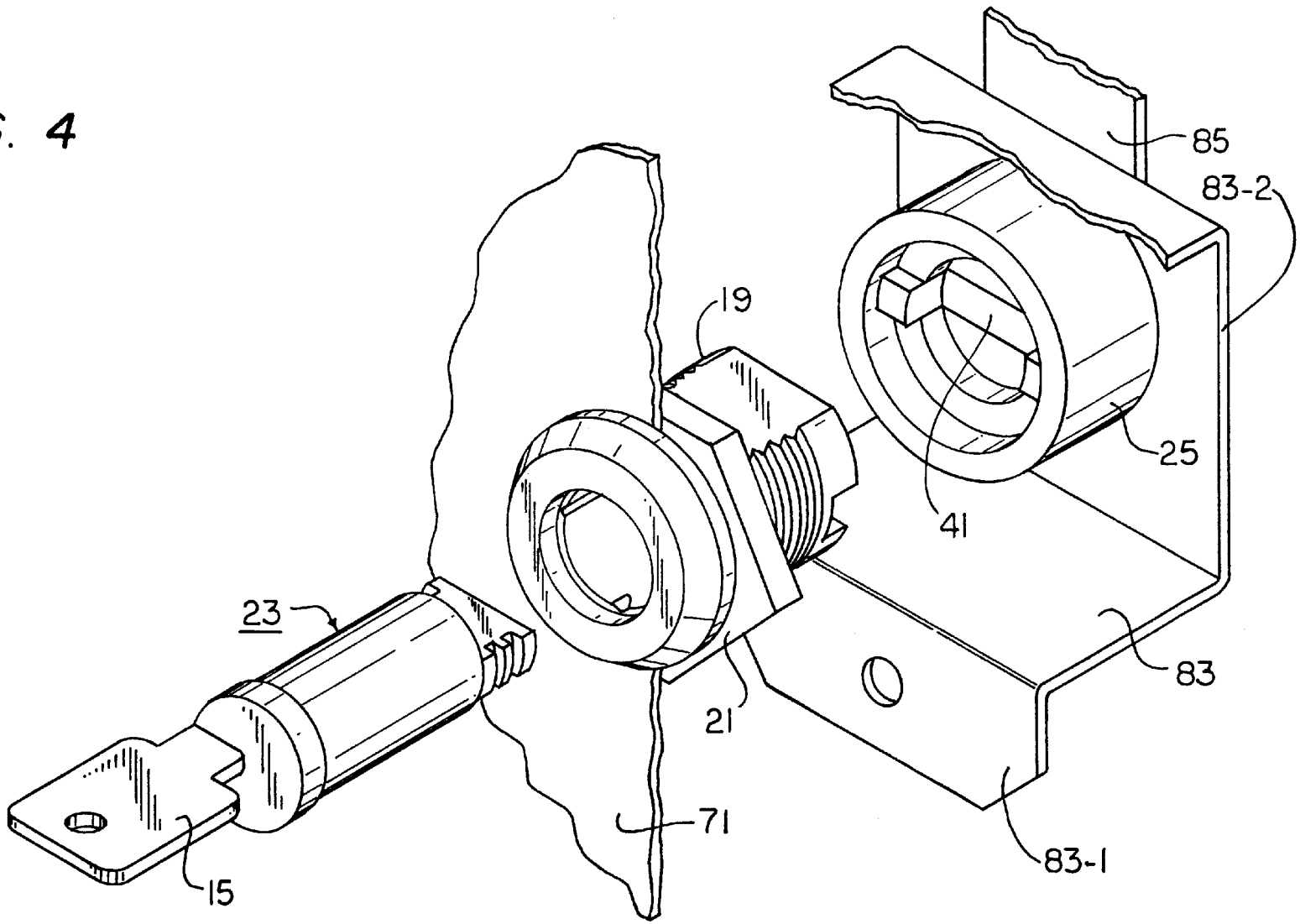
FIG. 4 is a partly exploded perspective view of the lock and key in FIG. 1 and related structure.

Shell 19, as can be seen for example in FIG. 4, is fixedly disposed through a hole provided in side panel 71 and held securely in place by nut 21. Cam module 25 is rotationally mounted on a bracket 83 which, in turn, is fixedly secured to side panel 71 by any suitable means, such as welding. Bracket 83 is preferably a hat shaped bracket comprising a pair of outer flanges 83-1 which are mounted onto side panel 71 and a center portion 83-2 rides in a groove 25-1 formed in cam module 25 so that bracket 83 does not interfere with rotational movement of cam module 25 relative to shell 19 when tool 17 is turned.

Figure 9:
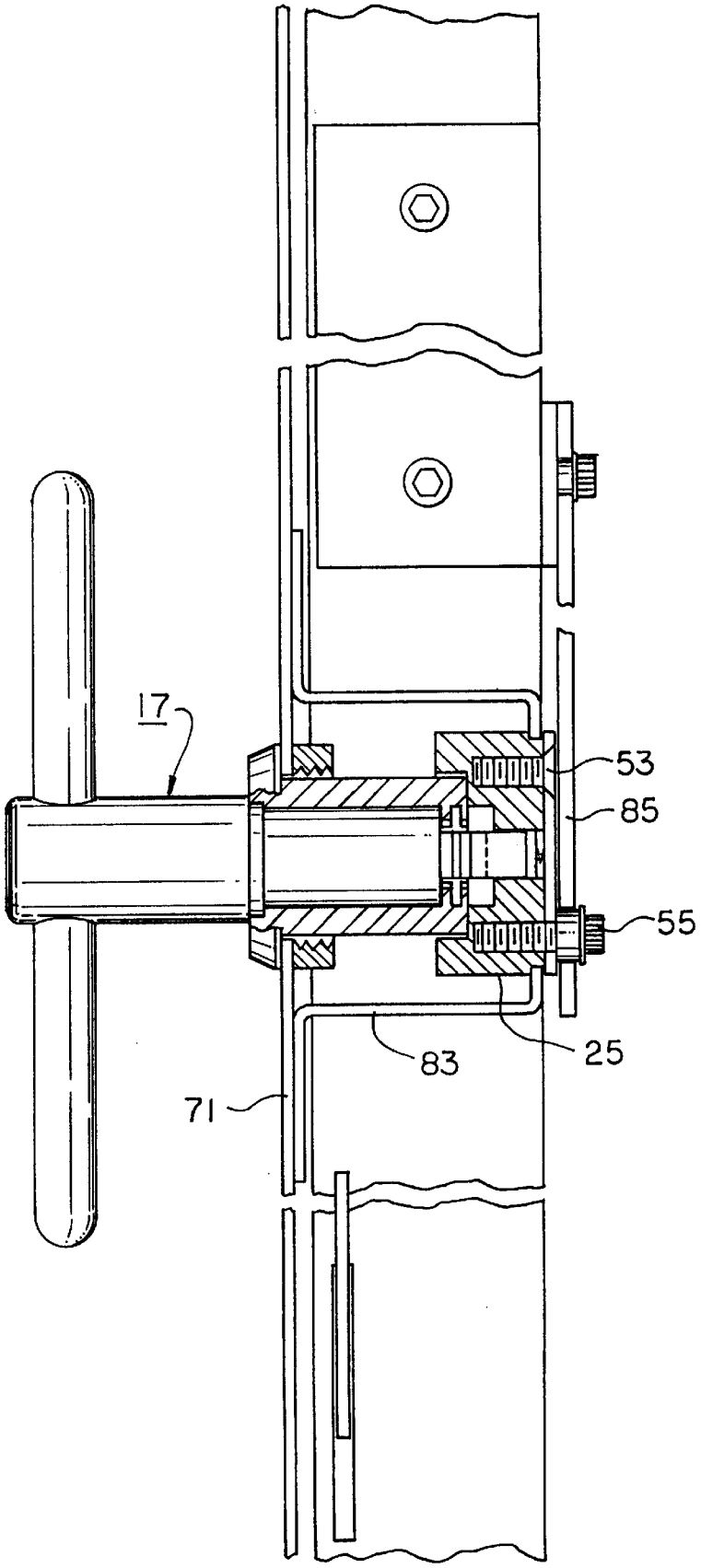
FIG. 9 is the view as shown in FIG. 8, but with the tool inserted in the shell and the cam module in a first position.
Figure 10:
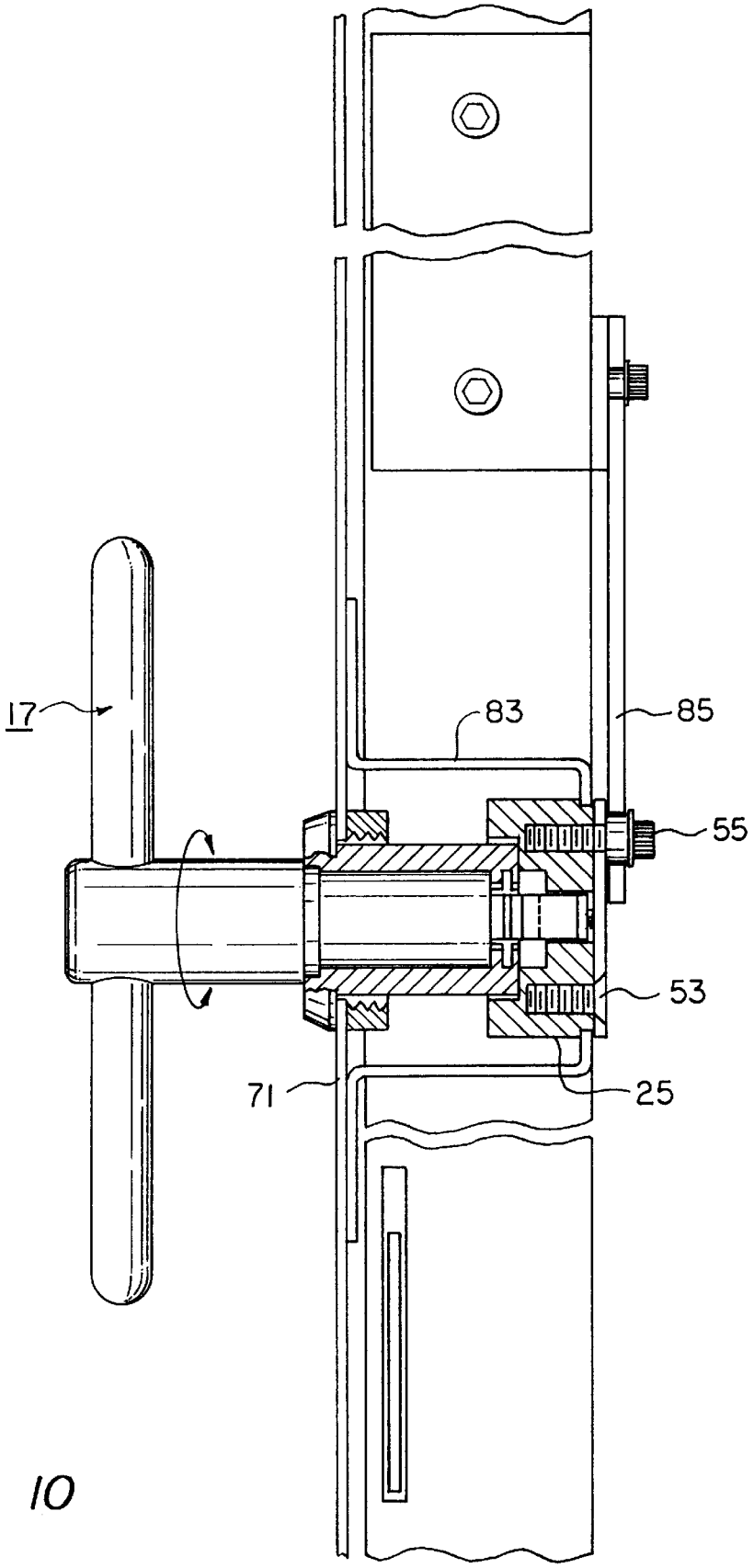
FIG. 10 is a view shown in FIG. 8, with tool inserted in the shell and rotated so that the cam module is in a second position.

When tool 17 is initially inserted through shell 19 and into cam module 25 but not turned and door 75 is closed, cam module 25, bracket 85 and slide plate 101 will be as shown in FIGS. 9 and 11, with slide plate 101 in a lowered position so as to prevent door 75 from opening. However, when tool 17 is rotated 180 degrees, tool 17, in turn, rotates cam module 25 180 degrees about its axis. Rotation of cam module 25 180 degrees moves bracket 85 upward which, in turn, displaces slide plate 101 to a raised position so that latches 81 are aligned with slots 102, thereby enabling door 75 to be opened.

It should be noted that cabinet 69 is highly effective in providing a secure means for housing a device. However, it has been found that the ease in placing such a device within cabinet 69 can be difficult at times because door 75 can be opened only approximately 90 degrees.

Accordingly, referring now to FIGS. 16–19, there is shown a second embodiment of a cabinet constructed according to the teachings of the present invention, the cabinet being represented generally by reference numeral 111. As can be appreciated, cabinet 111 is similarly designed to enable objects, such as a card dispensing apparatus, to be lockably disposed therewithin for security purposes.

Cabinet 111 differs from cabinet 69 only in that cabinet 111 comprises a hinge assembly 113 for pivotally mounting first side edge 75-3 of door 75 onto side panel 72 which differs slightly in construction from hinge assembly 78. As will be described further in detail below, hinge assembly 113 enables door 75 to be opened approximately 180 degrees, which is highly desirable in certain applications.

Figure 17:
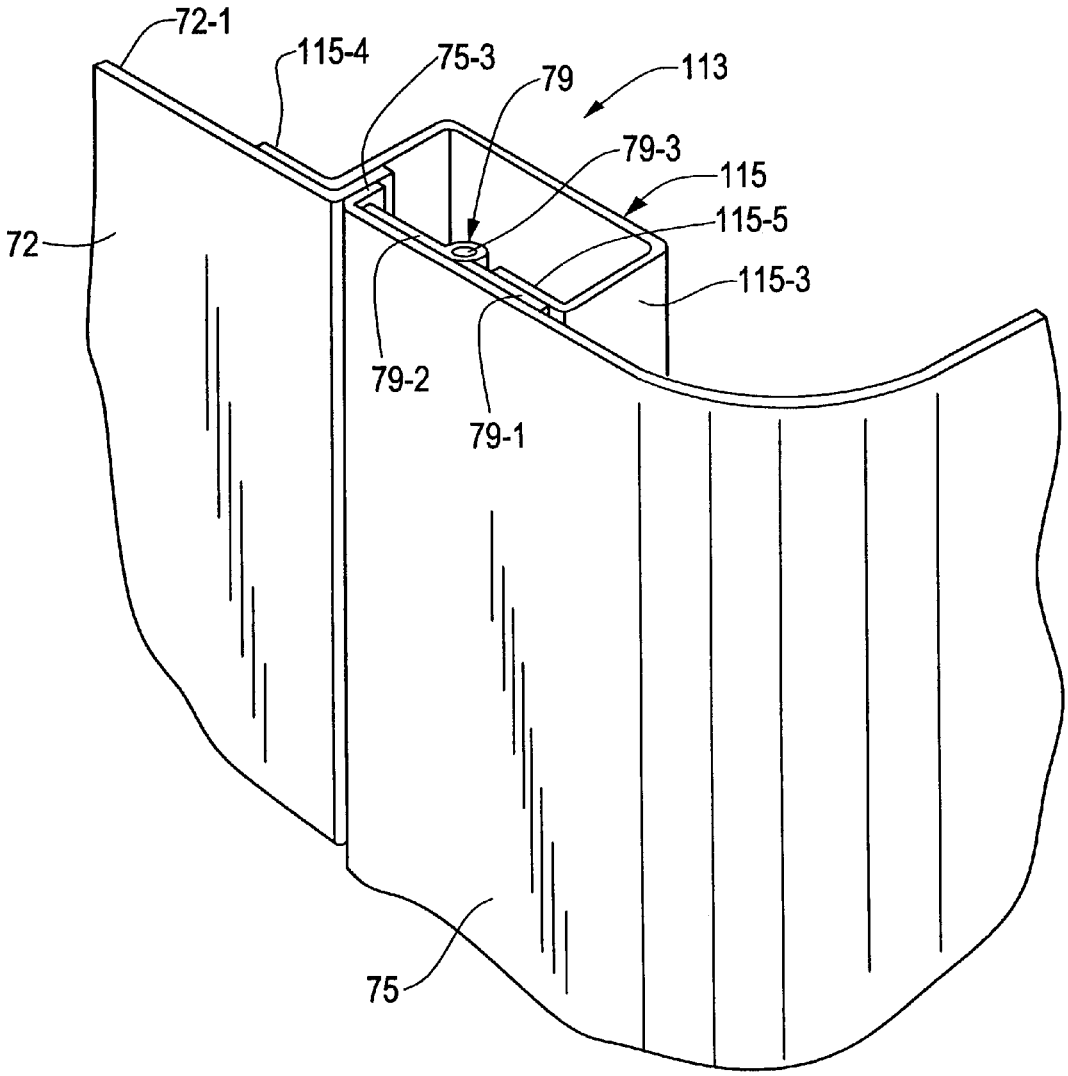
FIG. 17 is fragmentary perspective view of the hinge assembly shown in FIG. 16.
Figure 18:
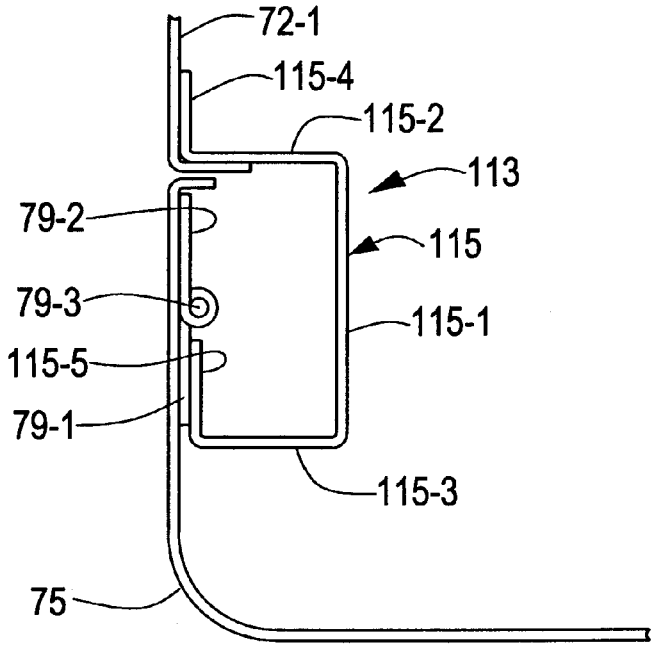
FIG. 18 is a top plan view of the hinge assembly shown in FIG. 16 when the door is in the closed position.
Figure 19:
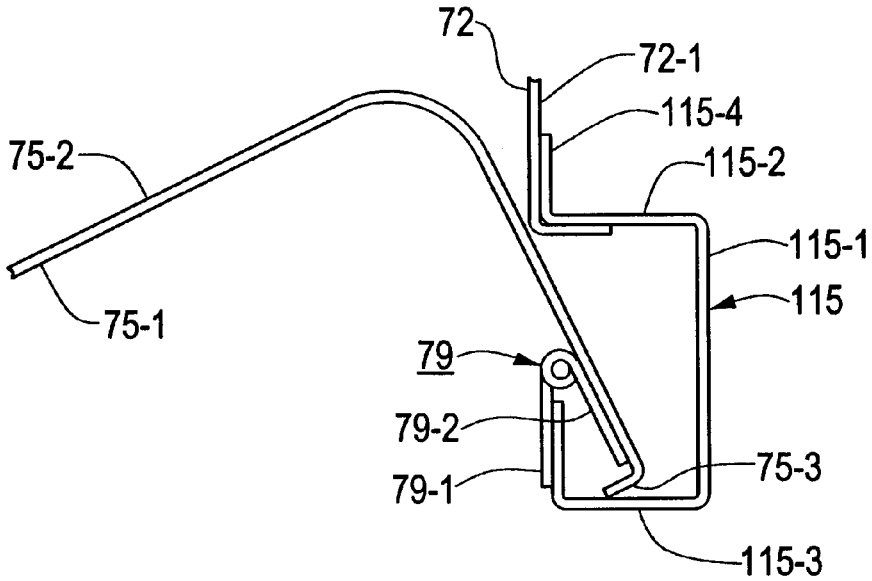
FIG. 19 is a top plan view of the hinge assembly shown in FIG. 16 when the door is in an open position.

Referring now to FIGS. 17–19, hinge assembly 113 comprises elongated butt hinge 79 and an elongated bracket 115. As can be appreciated, hinge assembly 113 differs from hinge assembly 78 only in that elongated bracket 115 differs in construction from elongated bracket 80.

Specifically, bracket 115 is preferably constructed of a rigid and durable material. Bracket 115 comprises a base 115-1 which is generally rectangular. Bracket 115 also comprises first and second legs 115-2 and 115-3 which extend orthogonally out from opposite ends of base 115-1. Bracket 115 further comprises first flange 115-4 which extends orthogonally out from first leg 115-2 in the direction away from second leg 115-3. In addition, bracket 115 comprises a second flange 115-5 which extends orthogonally out from second leg 115-3 in the direction towards first leg 115-2.

First flange 115-4 of bracket 115 is fixedly mounted onto an interior surface 72-1 of side panel 72 by any suitable means, such as by an adhesive or through welding. Additionally, second flange 115-5 of bracket 115 is fixedly mounted onto first leaf 79-1 of butt hinge 79 by any suitable means, such as by an adhesive or through welding. Furthermore, second leaf 79-2 of butt hinge 79 is fixedly mounted onto interior surface 75-1 of door 75 at first side edge 75-3 by any suitable means, such as by an adhesive or through welding.

As a principal feature of the present invention, it should be noted that due to the lengthening of base 115-1 and the inward extension of second flange 115-2, door 75 is capable of being opened approximately 180 degrees. Specifically, door 75 is capable of rotation between a closed position and an approximately 180 degree open position in the following manner. With first leaf 79-1 of butt hinge 79 fixedly mounted onto second flange 115-5 of bracket 115, second leaf 79-2 can be rotated about elongated pivot bar 79-3 until second leaf 79-2 is substantially parallel with first leaf 79-1. Positioning second leaf 79-2 at approximately 180 degrees relative first leaf 79-1, in turn, disposes door 75 in its closed position, as shown in FIGS. 17 and 18.

Rotation of door 75 in a clockwise direction, in turn, causes second leaf 79-2 to rotate in a clockwise direction relative elongated pivot bar 79-3. Door 75 is capable of clockwise rotation for approximately 180 degrees until second leaf 79-2 is substantially parallel with and almost in contact with second flange 115-5, as shown in FIG. 19. Door 75 is capable of clockwise rotation until door 75 reaches its open position in which first side edge 75-3 of door 75 is in abutment against second leg 115-3 of bracket 115.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A cabinet comprising:

(a) a first side panel and a door, the first side panel and the door each having an interior surface, and (b) a hinge assembly for hingedly connecting the door to the first side panel, said hinge assembly comprising:

(i) a bracket coupled to the interior surface of the first side panel and (ii) a hinge coupled to said bracket and to the interior surface of the door, (c) said hinge assembly enabling the door to pivot between a closed position and an open position, the open position being approximately 180 degrees relative to the closed position, said hinge comprising a first leaf, a second leaf and a pivot bar, said first leaf and said second leaf being capable of independent rotation about said pivot bar, said first leaf of said hinge being fixedly secured onto said bracket and the second leaf of said hinge being fixedly secured to the interior surface of the door, said bracket comprising a base, first and second legs and first and second flange, said first flange extending orthogonally out from said first leg in a direction away from said second flange and said second flange extending orthogonally out from said second leg in a direction toward said first flange.

2. The cabinet as claimed in claim 1 further comprising, a) a latch fixedly mounted on the door, b) a second side panel, c. a slide plate slidably mounted on the second side panel, said slide plate being disposed to be displaced between an upward position and a downward position, said slide plate engaging said latch on the door when said slide plate is disposed in one of the upward and downward positions, and d. a lock assembly coupled to said slide plate for displacing said slide plate between its upward position and its downward position.

3. The cabinet as claimed in claim 2 wherein said lock assembly comprises, a. a shell having a front end, a rear end, and a central bore extending from the front end to the rear end;

b. a key operated plug axially aligned and rotatably and removably disposed within the central bore of said shell;

c. a cam module rotatably mounted on the rear end of the shell;

d. a key insertable into said plug for removing said plug from said shell; and e. a tool insertable through the central bore in said shell into said cam module when said key operated plug is removed from said shell for rotationally moving said cam module relative to said shell.

4. The cabinet as claimed in claim 2 wherein the second side panel comprises a flange having a slot which is disposed in alignment with said latch when the door is moved into a closed position.

5. The cabinet as claimed in claim 4 wherein said latch comprises a hook and a mounting plate.

* * * * *